US008305157B2

(12) United States Patent
Lee et al.

(10) Patent No.: US 8,305,157 B2
(45) Date of Patent: Nov. 6, 2012

(54) WAVEGUIDE ADAPTER FOR CONVERTING LINEARLY POLARIZED WAVES INTO A CIRCULARLY POLARIZED WAVE INCLUDING AN IMPEDANCE MATCHING METAL GRATE MEMBER

(75) Inventors: Taek Kyung Lee, Goyang-si (KR); Kwang Jae Lee, Incheon (KR); Duk Jae Woo, Anseong-si (KR)

(73) Assignee: University Industry Cooperation Foundation Korea Aerospace University (KR)

( * ) Notice: Subject to any disclaimer, the term of this patent is extended or adjusted under 35 U.S.C. 154(b) by 160 days.

(21) Appl. No.: 12/669,086

(22) PCT Filed: Dec. 15, 2009

(86) PCT No.: PCT/KR2009/007508

§ 371 (c)(1),
(2), (4) Date: Jan. 14, 2010

(87) PCT Pub. No.: WO2010/087580

PCT Pub. Date: Aug. 5, 2010

(65) Prior Publication Data

US 2011/0018656 A1 Jan. 27, 2011

(30) Foreign Application Priority Data

Jan. 30, 2009 (KR) ..... 10-2009-0007483

(51) Int. Cl.
*H01P 1/17* (2006.01)

(52) U.S. Cl. ..... 333/21 A; 333/33

(58) Field of Classification Search ..... 333/21 A, 333/33, 137

See application file for complete search history.

(56) References Cited

U.S. PATENT DOCUMENTS 4,707,702 A * 11/1987 Withers ..... 343/786
5,619,173 A * 4/1997 King et al. ..... 333/125
6,727,776 B2 * 4/2004 Kanamaluru ..... 333/21 A

* cited by examiner

*Primary Examiner* — Benny Lee
(74) *Attorney, Agent, or Firm* — Cantor Colburn LLP

(57) ABSTRACT

Disclosed is a waveguide adapter able to generate a circularly polarized wave. The waveguide adapter to be coupled with a horn antenna realizes a polarized wave conversion function for converting a linearly polarized wave signal into a circularly polarized wave signal, or vice versa, and an adapter function for converting a waveguide signal into an external transmission line signal, resulting in a simplified configuration and small size of a communication system using a circularly polarized wave signal. The waveguide adaptor includes a probe to transmit a linearly polarized wave signal from an external transmission line to a waveguide transmission line, a polarized wave conversion line reflector located in the rear of the probe to convert a vertically polarized wave into a horizontally polarized wave, and a back-short member to forwardly transmit a rearward signal. The waveguide adapter is applicable to communication systems using circularly polarized wave signals.

8 Claims, 9 Drawing Sheets

WAVEGUIDE ADAPTER FOR CONVERTING LINEARLY POLARIZED WAVES INTO A CIRCULARLY POLARIZED WAVE INCLUDING AN IMPEDANCE MATCHING METAL GRATE MEMBER

BACKGROUND OF THE INVENTION

1. Field of the Invention

The present invention relates to a waveguide adapter able to generate a circularly polarized wave, this waveguide adapter enabling optimal generation of a circularly polarized wave signal for use in communication systems using circularly polarized wave signals and artificial satellite communication systems.

2. Description of the Related Art

A satellite communication system is installed in an artificial satellite for communication between the satellite orbiting in space and an earth station. To be installed in the artificial satellite, the satellite communication system entails features of low weight and a high degree of strength. Accordingly, it is necessary for the satellite communication system to achieve a maximally simplified configuration and small size.

In the meantime, although such a satellite communication system utilizes a circularly polarized wave signal for ease in transmission of signals to or from the ground, most general signal generators and antennas have characteristics of a linearly polarized wave. Therefore, there is a need for a special polarized wave conversion structure.

A high strength waveguide is widely used in a satellite communication system, to transmit a high output signal. Such a waveguide needs a conversion device (i.e. an adapter), which connects a transmission line of the waveguide and a transmission line of a satellite communication system to each other, so as to transmit a signal processed in the satellite communication system to, e.g., a horn antenna.

A communication system using a circularly polarized wave signal has advantages of excellent signal transmission characteristics with respect to the surrounding environment and separation of a left hand circularly polarized wave signal and a right hand circularly polarized wave signal and therefore, has been applied in many fields including satellite communication, mobile communication, radio frequency identification systems (RFID), and the like. With this tendency, there is a great demand for a circularly polarized wave generator and a waveguide adaptor.

However, due to the fact that the use of a circularly polarized wave generator and a waveguide adaptor are necessarily required in order to generate a circularly polarized wave, a conventional communication system using a circularly polarized wave signal disadvantageously entails an increased size and complex system configuration.

SUMMARY OF THE INVENTION

Therefore, the present invention has been made in view of the problems associated with the above described conventional communication system using a circularly polarized wave signal, and it is an object of the present invention to provide a waveguide adaptor able to generate a circularly polarized wave, which enables optimal generation of a circularly polarized wave signal for use in communication systems using circularly polarized wave signals and artificial satellite communication systems.

It is another object of the present invention to provide a waveguide adaptor able to generate a circularly polarized wave, which is designed to be coupled with a horn antenna in the form of a waveguide and can singly realize a polarized wave conversion function for converting a linearly polarized wave signal into a circularly polarized wave signal, or vice versa and an adapter function for converting a waveguide signal into an external transmission line signal, whereby the waveguide adaptor can accomplish a simplified configuration and small size of a communication system using a circularly polarized wave signal.

In accordance with the present invention, the above and other objects can be accomplished by the provision of a waveguide adapter able to generate a circularly polarized wave including a polarized wave conversion line reflector provided in the rear of a probe that serves to transmit a linearly polarized wave signal introduced from an external transmission line into a waveguide, the polarized wave conversion line reflector serving to convert a vertically polarized wave into a horizontally polarized wave, and a back-short member to forwardly transmit a signal transmitted rearward through the polarized wave conversion line reflector.

The external transmission line may be any one selected from the group consisting of a coaxial transmission line, a micro-strip transmission line, a coplanar waveguide (CPW), and a strip transmission line.

The waveguide adapter may further include a dielectric member to increase a polarized wave bandwidth.

The dielectric member may be installed between the probe and the polarized wave conversion line reflector, and may be shaped to partially convert the wavelength of an electric wave within the waveguide.

The waveguide adapter may further include a metal grate member to improve impedance matching.

In particular, the metal grate member may be inserted to a position close to the probe.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter, preferred embodiments of the present invention will be described in detail with reference to the accompanying drawings. In the following description of the present invention, a detailed description of known functions and configurations incorporated herein will be omitted so as not to obscure the subject matter of the present invention.

Figure 1:
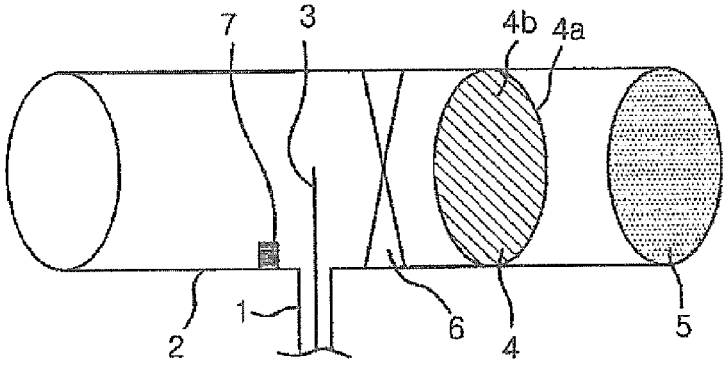
FIG. 1 is a schematic diagram illustrating a configuration of a waveguide adaptor able to generate a circularly polarized wave according to an embodiment of the present invention.
Figure 2A:
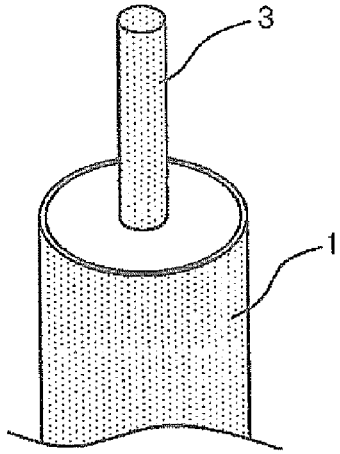
FIG. 2A is a view illustrating an exemplary shape of a coaxial transmission line to be coupled to a waveguide.
Figure 2B:
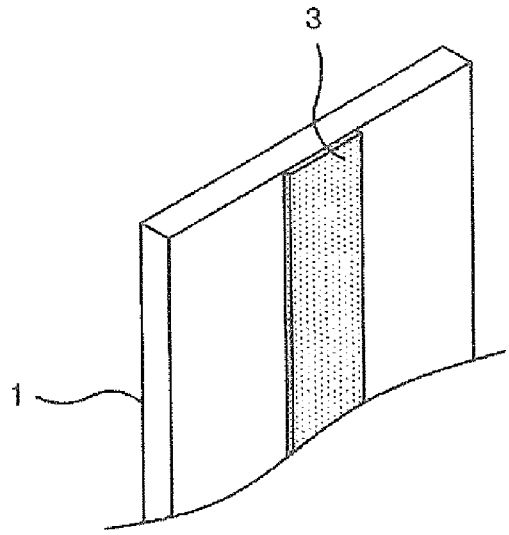
FIG. 2B is a view illustrating an exemplary shape of a micro-strip transmission line to be coupled to a waveguide.
Figure 3A:
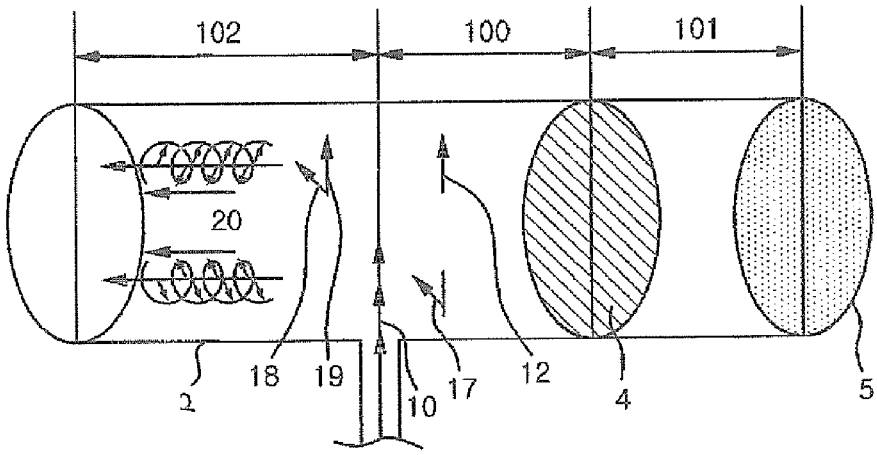
FIGS. 3A and 3B are views illustrating electric field propagation and polarized wave conversion within the waveguide adaptor able to generate a circularly polarized wave according to an exemplary embodiment of the present invention.
Figure 3B:
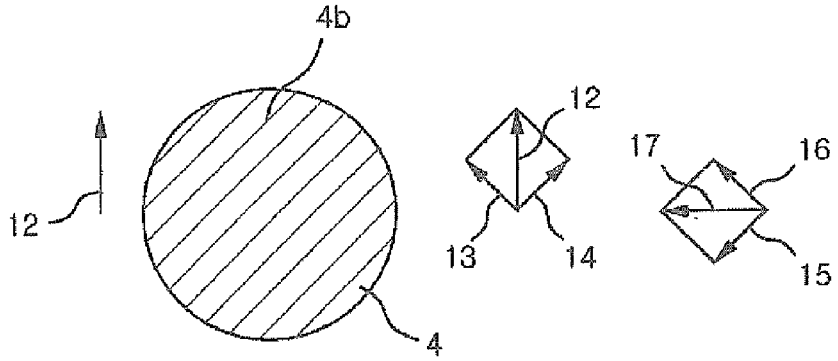
Figure 4:
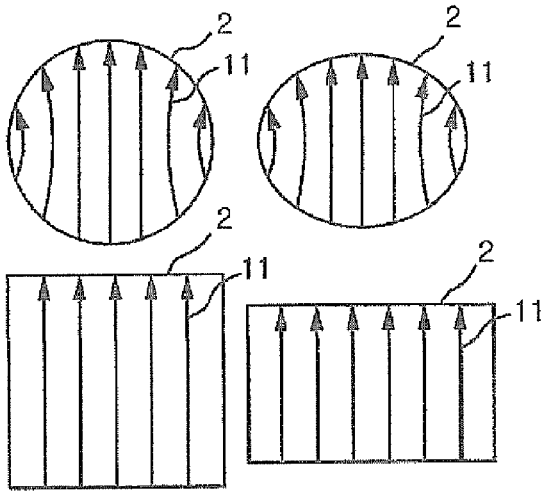
FIG. 4 is a view illustrating the distribution of an electric field of a fundamental $TE_{11}$ mode (or $TE_{10}$ mode) within a waveguide.

FIG. 1 is a schematic diagram illustrating a configuration of a waveguide adaptor able to generate a circularly polarized wave according to an embodiment of the present invention. FIG. 2A is a view illustrating an exemplary shape of a coaxial transmission line to be coupled to a waveguide, and FIG. 2B is a view illustrating an exemplary shape of a micro-strip transmission line to be coupled to a waveguide. FIGS. 3A and 3B are views illustrating electric field propagation and polarized wave conversion within the waveguide adaptor able to generate a circularly polarized wave according to an exemplary embodiment of the present invention. FIG. 4 is a view illustrating the distribution of an electric field of a fundamental $TE_{11}$ mode (or $TE_{10}$ mode) within a waveguide.

Figure 5A:
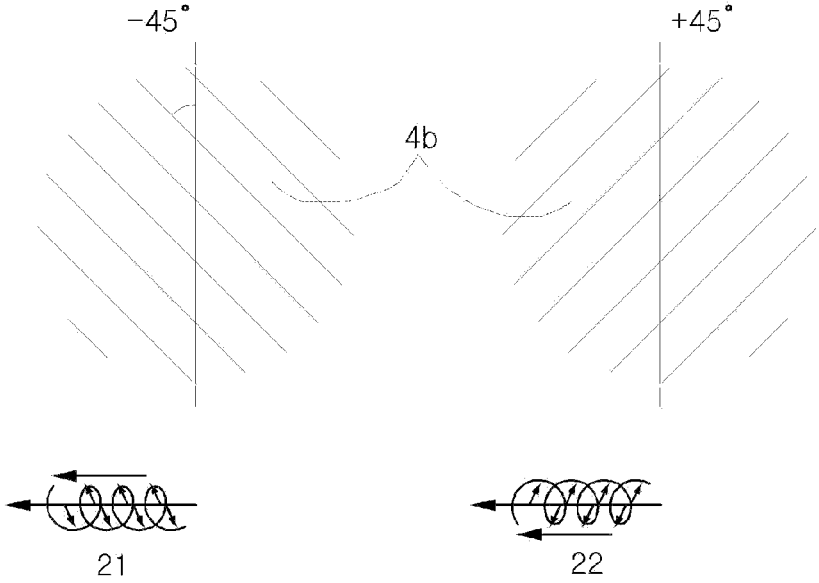
FIG. 5A is a view illustrating examples of a polarized wave conversion line reflector.
Figure 5B:
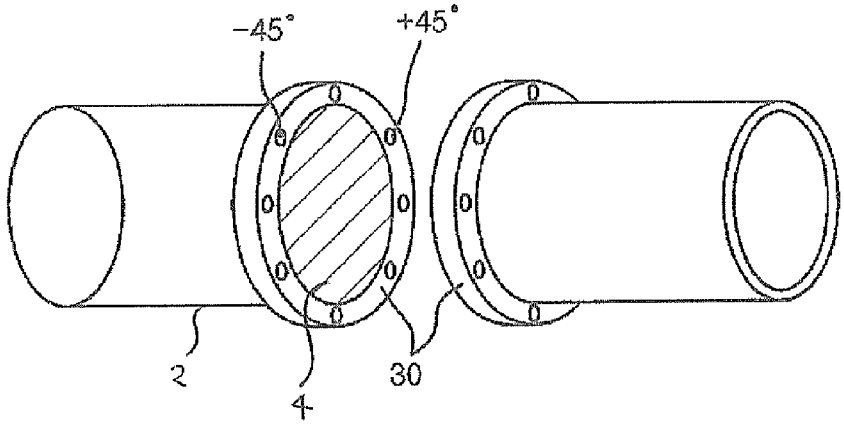
FIG. 5B is a view illustrating examples of a polarized wave conversion line reflector.
Figure 6:
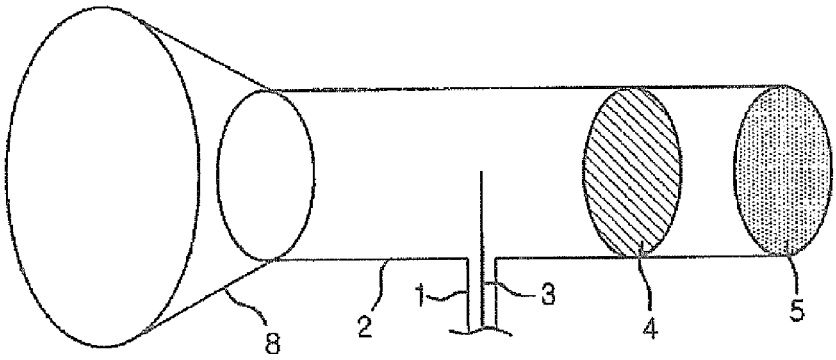
FIG. 6 is a view illustrating a coupling relationship between a waveguide adapter able to generate a circularly polarized wave and a horn antenna according to an exemplary embodiment of the present invention.

FIG. 5A is a view illustrating examples of a polarized wave conversion line reflector, and FIG. 5B is a view illustrating examples of a polarized wave conversion line reflector. FIG. 6 is a view illustrating a coupling relationship between a waveguide able to generate a circularly polarized wave and a horn antenna according to an exemplary embodiment of the present invention.

Referring to FIGS. 1, 2A, 2B, 3A, 3B, 4, 5A, 5B and 6, the waveguide adaptor according to the embodiment includes a probe 3, a polarized wave conversion line reflector 4, and a back-short member 5. The probe 3 serves to transmit a linearly polarized wave signal from an external transmission line 1 (e.g., a coaxial transmission line as shown in FIG. 2A or a micro-strip transmission line as shown in FIG. 2B) into a waveguide 2. The external transmission line 1 may also be a coplanar waveguide (CPW) or a stripline (both not shown). The polarized wave conversion line reflector 4 is located to the rear of the probe 3 and serves to convert a vertically polarized wave into a horizontally polarized wave. The back-short member 5 serves to forwardly transmit a signal having been transmitted rearwardly through the polarized wave conversion line reflector 4. Here, the probe 3 has a predetermined height or a specific shape suitable for impedance matching at a corresponding operation frequency.

As shown in FIGS. 3A and 3B, the polarized wave conversion line reflector 4 may be located to the rear of the probe 3 by a distance 100. Although not shown in FIGS. 3A and 3B, the probe 3 is located along an initial transmission path such that a linearly polarized wave signal is initially transmitted into the waveguide 2 therethrough. The distance 100 is equal to one eighth a guided wavelength at a corresponding frequency (as represented by $(2n+1)/8$, $n=0, 1, 2, 3 \ldots$). Here, as shown in FIG. 1, the polarized wave conversion line reflector 4 includes a substrate 4*a*, and lines 4*b* formed on the substrate 4*a* so as to be spaced apart from one another by a predetermined distance. The lines 4*b* are preferably made of a metal.

The back-short member 5, which serves to transmit all signals forward, may be located to the rear of the polarized wave conversion line reflector 4 by a distance 101. The distance 101 is equal to a quarter guided wavelength.

In addition, as shown in FIG. 1, a dielectric member 6, which has an electric permittivity different from air, may be inserted into the waveguide 2 at a position between the probe 3 and the polarized wave conversion line reflector 4 for the purpose of an extended polarized wave bandwidth. Alternatively, as shown in FIG. 1, a metallic grate member 7 may be inserted into the waveguide 2 at a position near the probe 3 for the purpose of improved impedance matching.

Hereinafter, operation of the waveguide adaptor able to generate a circularly polarized wave having the above described configuration according to the embodiment of the present invention will be described in detail.

As shown in FIG. 3A, the linearly polarized wave signal 10 is transmitted into the waveguide 2 through the probe 3 (FIG. 1). Although the probe 3 is preferably positioned perpendicular to the waveguide 2 in order to generate an electric field of a fundamental $TE_{11}$ mode (or $TE_{10}$ mode), the shape of the probe 3 may be slightly deformed for the purpose of improved impedance matching and extended polarized wave bandwidth. As shown in FIG. 4, an electric field 11 of a fundamental $TE_{11}$ mode or $TE_{10}$ mode is generated in the circular (elliptical, rectangular, or square) waveguide 2. More particularly, the circular or elliptical waveguide 2 shows generation of a $TE_{11}$ mode electric field 11, and the rectangular or square waveguide 2 shows generation of a $TE_{10}$ mode electric field 11. Signals having a vertical electric field pattern shown in FIG. 4 are equally divided and transmitted forward and rearward of the probe 3. In particular, a rearward transmitted vertical electric field signal 12 in FIG. 3A reaches the polarized wave conversion line reflector 4 that is spaced apart from the probe 3 by the distance 100 equal to one eighth a guided wavelength at a corresponding frequency, thus undergoing a phase change (i.e. phase shift) of 45 degrees (more particularly, $(45 \cdot 2n+1)$ degrees, $n=0, 1, 2, 3 \ldots$). In this case, the polarized wave conversion line reflector 4 has a line pattern as shown in the right side of FIG. 5A, in which the lines 4*b* have an inclination angle of +45 degrees with respect to a direction of the vertical electric field signal 12 introduced into the polarized wave conversion line reflector 4. Here, the lines 4*b* may be made of a metal, and the width and distance of the lines 4*b* may be appropriately adjusted according to an operation frequency.

The $TE_{11}$ mode vertically polarized wave signal 12 transmitted from the probe 3 may be represented by the vector sum of a vertical component 13 and a horizontal component 14 on the basis of the line 4*b* having the inclination angle of 45 degrees as shown in FIG. 3B. In this case, the polarized wave conversion line reflector 4 selectively passes the vertical component 13 of the vertically polarized wave signal 12, but reflects the horizontal component 14 of the vertically polarized wave signal 12. More particularly, the reflector 4 reflects the horizontal component 14 forward after the horizontal component 14 has undergone a phase change of 180 degrees, causing a reflected signal 15 (FIG. 3B) with respect to the horizontal component 14 of the vertically polarized wave signal 12. On the other hand, the vertical component 13 of the vertically polarized wave signal 12, having passed through the polarized wave conversion line reflector 4, undergoes a phase change of 90 degrees while passing through the distance 101 equal to a quarter guided wavelength and subsequently, undergoes an additional phase change of 180 degrees by the back-short member 5. The back-short member 5 reflects the resulting component forward, so that the reflected component undergoes an additional phase change of degrees while again passing through the distance 101 equal to a quarter guided wavelength. When the resulting component again reaches the polarized wave conversion line reflector 4, the resulting reflected component is perpendicular to the line 4*b* and thus, wholly passes through the polarized wave conversion line reflector 4, causing a reflected signal 16 (FIG. 3B). In this case, since the reflected signal 16 with respect to the vertical component 13 is obtained by the total phase change of 360 degrees, the vector sum of the reflected signal 15 with respect to the horizontal component 14 and the reflected signal 16 of the vertical component 13 results in a forward transmitted signal, whereby the $TE_{11}$ mode vertically polarized wave signal 12 is converted into a horizontally polarized wave signal 17 (FIGS. 3A and 3B) and is reflected from the polarized wave conversion line reflector 4. As the reflected horizontally polarized wave signal 17 is transmitted forward toward the probe 3, the horizontally polarized wave signal 17 undergoes a phase change of 45 degrees while passing through the distance 100 equal to one eighth a guided wavelength. Accordingly, the $TE_{11}$ mode vertically polarized wave signal 12, initially transmitted rearward from the probe 3, is finally converted into a horizontally polarized wave 18 having a phase change of 90 degrees with the horizontal component 14 of the $TE_{11}$ mode vertically polarized wave signal. In this way as shown in FIG. 3A, the horizontally polarized wave 18 is synthesized with a vertically polarized wave 19 initially transmitted forward from the probe 3, whereby a circularly polarized wave 20 is generated and transmitted forward.

Referring to FIG. 3A and FIG. 5A, a left hand circularly polarized wave (LHCP) 21 (FIG. 5A) and a right hand circularly polarized wave (RHCP) 22 (FIG. 3A) are determined according to the combination of the distance 100 (FIG. 3A) between the probe 3 and the polarized wave conversion line reflector 4 and the clockwise or counterclockwise line direction (corresponding to the inclination of ±45 degrees as shown in FIG. 5A).

Here, a polarized wave determination equation is represented as follows:

$$P=(-1)^n\times\text{Line Inclination Angle of Line reflector}/45^\circ$$

Here, if P has a negative value, this corresponds to a left hand circularly polarized wave. On the other hand, if P has a positive value, this corresponds to a right hand circularly polarized wave.

In one example, when the distance 100 equal to one eighth a guided wavelength is combined with the counterclockwise line direction (corresponding to the inclination angle of −45 degrees of the line 4*b* of the reflector 4), the left hand circularly polarized wave 21 is generated.

In another example, when the distance 100 equal to one eighth a guided wavelength is combined with the clockwise line direction (corresponding to the inclination angle of +45 degrees of the line 4*b* of the reflector 4), the right hand circularly polarized wave 22 is generated.

In the meantime, as shown in FIG. 5B, the polarized wave conversion line reflector 4 may be coupled to the circular waveguide 2 by use of a variable device 30, so that a linearly polarized wave (i.e. −45 degrees) can be converted into a left hand circularly polarized wave or a right hand circularly polarized wave (i.e. +45 degrees) via a change in a fringe coupling position.

The resulting circularly polarized wave 20 may undergo an additional phase change (phase shift) while passing through an appropriate length of a waveguide region 102 shown in FIG. 3A and then, is emitted into the atmosphere through, e.g., an open end of a horn antenna 8 as shown in FIG. 6. In this case, the length of the waveguide region 102 shown in FIG. 3A has an effect on an axial ratio.

Assuming that a communication system receives a circularly polarized wave signal from an antenna, it will be appreciated that a process of converting the circularly polarized wave signal into a linearly polarized wave signal and transmitting the converted signal to the system will be performed in the reverse order of the above description.

As apparent from the above description, a waveguide adapter able to generate a circularly polarized wave according to the present invention enables optimal generation of a circularly polarized wave signal for use in communication systems using circularly polarized wave signals and artificial satellite communication systems.

Further, the waveguide adapter according to the present invention can be coupled to, e.g., a horn antenna in the form of a waveguide. The waveguide adapter can realize not only a polarized wave conversion function for converting a linearly polarized wave signal into a circularly polarized wave signal, or vice versa, but also an adapter function for converting a waveguide signal into an external transmission line signal. This has the effect of simplifying the overall configuration of a communication system using a circularly polarized wave signal while achieving a reduction in system size.

Furthermore, owing to a low weight and small size thereof, the waveguide adaptor, which also functions as a polarized wave converter according to the present invention, is optimally applicable to a satellite communication system.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A waveguide adapter able to generate a circularly polarized wave, the waveguide adapter comprising:

a polarized wave conversion line reflector disposed in a waveguide and provided to a rear of a probe disposed within the waveguide that serves to transmit a linearly polarized wave signal introduced from an external transmission line into the waveguide, the polarized wave conversion line reflector serving to convert a vertically polarized wave into a horizontally polarized wave;

a back-short member attached to the waveguide to forwardly transmit a signal transmitted rearwardly through the polarized wave conversion line reflector; and a metal grate member disposed within the waveguide to improve impedance matching of the waveguide adapter.

2. The waveguide adapter according to claim 1, wherein the external transmission line is any one selected from the group consisting of a coaxial transmission line, a micro-strip transmission line, a coplanar waveguide (CPW), and a strip transmission line.

3. The waveguide adapter according to claim 1, further comprising a dielectric member to increase a polarized wave bandwidth.

4. The waveguide adapter according to claim 3, wherein the dielectric member is installed between the probe and the polarized wave conversion line reflector.

5. The waveguide adapter according to claim 1, further comprising a horn connected to an end of the waveguide so as to emit a converted circularly polarized wave into the atmosphere.

6. The waveguide adapter according to claim 1, wherein the metal grate member is inserted to a position close to the probe.

7. The waveguide adapter according to claim 1, wherein the polarized wave conversion line reflector includes:

a substrate; and lines formed on the substrate to be spaced apart from one another by a predetermined distance.

8. The waveguide adapter according to claim 7, wherein the lines are made of a metal.

* * * * *